United States Patent [19]

Schreffler

[11] 3,984,164

[45] Oct. 5, 1976

[54] ELECTRICAL CONDUCTOR ARRANGEMENT INCLUDING A ROTATING FLEXUOUS ELECTRICAL CONTACTOR

[76] Inventor: Robert Z. Schreffler, 12817 Richmond St., Chester, Va. 23831

[22] Filed: Oct. 14, 1975

[21] Appl. No.: 622,059

[52] U.S. Cl. ..... 339/5 R; 310/219; 339/8 PB

[51] Int. Cl.[2] ..... H01R 39/00

[58] Field of Search ..... 339/5 R, 5 A, 5 M, 5 P, 339/5 S, 8 PB; 310/219

[56] References Cited

UNITED STATES PATENTS

| | | | |
|---|---|---|---|
| 388,513 | 8/1888 | Van Gestel | 310/219 |
| 3,769,535 | 10/1973 | Bates | 310/219 |
| 3,940,200 | 2/1976 | Schreffler | 339/8 PB |

*Primary Examiner*—Roy Lake
*Assistant Examiner*—DeWalden W. Jones
*Attorney, Agent, or Firm*—Larson, Taylor and Hinds

[57] ABSTRACT

An electrical conductor arrangement is provided for the conducting of electrical currents from a rotating shaft to a non-rotating conductor. The arrangement provides for an electrically conductive worm with helical grooves affixed to the shaft so as to rotate therewith and a flexuous electrical contactor disc, formed by a plurality of flexible electrically conductive fibers projecting radially from a central annular hub, which is rotatably mounted such that the fiber surfaces adjacent to the ends of the conductive fibers engage the walls of the helical grooves of the worm. As the shaft and worm rotate, successive ones of the electrically conductive fibers contact and move with the worm helix causing the flexuous electrical contactor disc to rotate at a reduced speed determined by the radius of the disc and the number of grooves of the worm helix. The rotatable mounting for the flexuous electrical contactor includes a flexible conductive annular race which cooperates with intermediate electrically conductive ball bearings and a further race in the central hub of the conductive disc. The non-rotating conductor is a wire conductor attached to the flexible conductive annular race.

In a preferred embodiment, the axis of the flexuous electrical contactor disc is mounted at an oblique angle to a plane perpendicular to the axis of the worm.

7 Claims, 7 Drawing Figures

FIG. 4
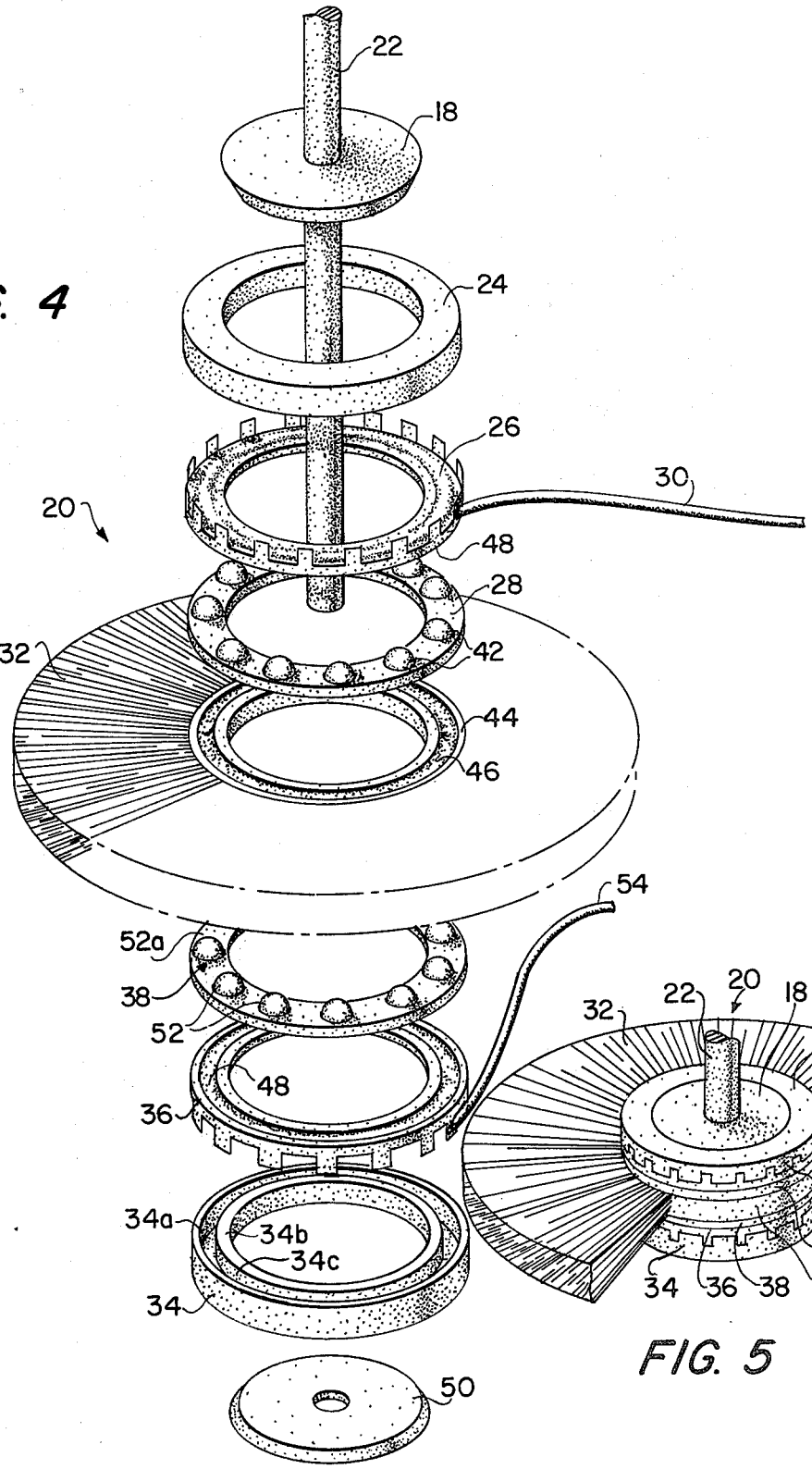
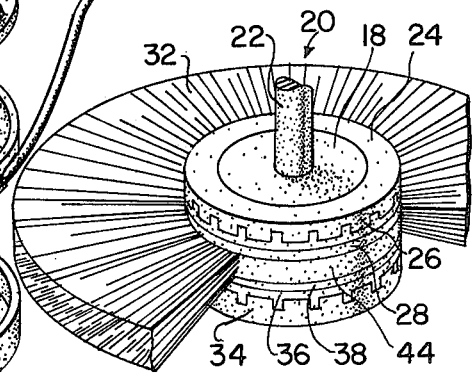
FIG. 5

ELECTRICAL CONDUCTOR ARRANGEMENT INCLUDING A ROTATING FLEXUOUS ELECTRICAL CONTACTOR

FIELD OF THE INVENTION

The present invention relates to electrical conductor arrangements for conducting current between a conductor on a rotating shaft and a non-rotating conductor.

BACKGROUND OF THE INVENTION

There are a number of different devices or systems for conducting electrical current between a rotating current-carrying component and a contacting stationary conductor. Some include familiar systems employing conventional slip-rings, commutators or the like. Other systems, similar to that disclosed in U.S. Pat. No. 388,513 (Van Gestel) use gearing systems that provide electrical conduction through intermeshing gears. Such systems are relatively expensive to manufacture, cumbersome to assemble and use, and due to wear, are unreliable and inefficient after extended use at high rotational speeds. In addition, because it is difficult to maintain positive meshing of the gears, sparking and heating problems often result.

Another approach, which is of particular interest here and which is disclosed in U.S. Pat No. 3,769,535 (Bates), uses a wire brush disc mounted with its axis parallel to the axis of the rotating shaft. The shaft has a metallic disc having a smooth edge mounted thereon, and the wire brush is positioned such that the tips of the wire bristles engage and rub against the edge of the metallic disc. This approach has a number of drawbacks. For example, because both discs rotate in the same plane, it is necessary that the brush fibers be deformed and then compressed as they pass the tangent point. The closer the discs are positioned to each other, in order to increase their contact, the greater the deformation of the brush fibers. Thus, such a system requires minimal contact if the wear on the brushes is to be minimized. Because of the low frictional forces between the discs, it is often required to have a separate rotational drive source for the brush disc in order to keep the disc in motion, especially at low speeds. A further significant drawback, and one that is common to "gearing" systems as well, is that these systems require an electrical "brush" contactor, (a conventional wiper brush which makes contact with a gear, in van Gestel, and a disc brush, in Bates). Conventional wiper brushes suffer from severe wear problems and provide poor contact at high rotational speeds.

SUMMARY OF THE INVENTION

According to the invention, an electrical conductor arrangement for conducting current between a stationary conductor and a rotating shaft is provided that overcomes the shortcomings of the prior art discussed above. The arrangement of the invention comprises a flexuous electrical contactor disc which is formed by a plurality of flexible electrically conductive fibers projecting radially from a central annular hub and is rotatably mounted on a support positioned such that the fiber surfaces adjacent to the ends of the conductive fibers engage the sides of the grooves of a worm mounted on the shaft for rotation therewith. As the worm rotates, successive bundles or clusters of the conductive fibers are trapped and confined within the side walls of the grooves of the worm causing the conducting flexuous electrical contactor or disc to rotate at a reduced speed as determined by the radius of the flexuous contact or disc, and the number of grooves per inch of the worm helix.

According to a further aspect of the invention, electrical current conduction between the conducting flexuous electrical contactor and the non-rotating conductor is achieved by means of a bearing assembly comprising a flexible race, fixedly mounted to the support and electrically connected to the non-rotating conductor, cooperating an intermediate ball bearing assembly and a further race disposed on one side of the central hub of the flexuous electrical contactor disc. In order to aid in carrying high amperage electrical currents, a second parallel race assembly is provided on the other side of the hub. A bearing assembly of this general type is described in detal in corresponding patent application No. 555,277, filed on Mar. 4, 1975, now U.S. Pat. No. 3,940,200 and entitled "Electrical Conductor Arrangement Including Flexible Race Construction."

In a first embodiment, the flexuous electrical contactor disc is positioned relative to the worm such that the axis of the flexuous electrical contactor disc lies in a plane perpendicular to the axis of the worm and the sides adjacent to the ends of the conductive fibers contact the worm groove walls at a point spaced in the direction of rotation from a line projecting radially from the axis of the worm and within a plane perpendicular to the axis of the flexuous electrical contactor disc.

In an alternate arrangement, the flexuous electrical contactor disc is positioned relative to the worm such that the axis of the flexuous electrical contactor disc assembly is canted at an angle oblique to a plane perpendicular to the axis of the worm.

Both of the above mentioned positions afford increased fiber contact with the worm as well as decreased deflection thereof.

Other features and advantages of the invention will be set forth in, or apparent from, the detailed description of a preferred embodiment found hereinbelow.

BRIEF DESCRIPTION OF THE DRAWINGS

FIG. 4 is an exploded perspective view of the flexuous electrical contactor disc according to the invention;

FIG. 5 is a perspective view, partially cut away, of the disc assembly shown in FIG. 4;

DESCRIPTION OF THE PREFERRED EMBODIMENT

Figure 1:
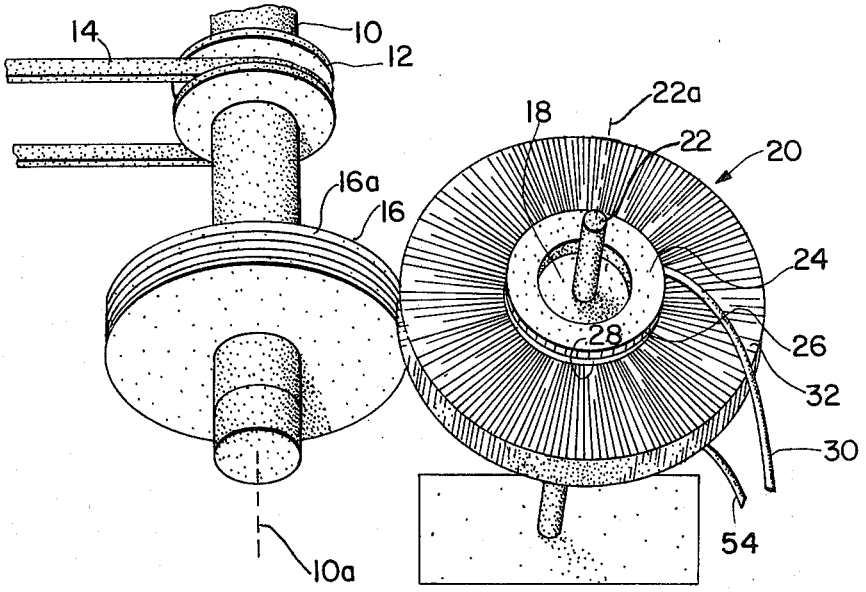
FIG. 1 is a perspective view of an electrical conductor arrangement according to the invention, taken generally from above.
Figure 2:
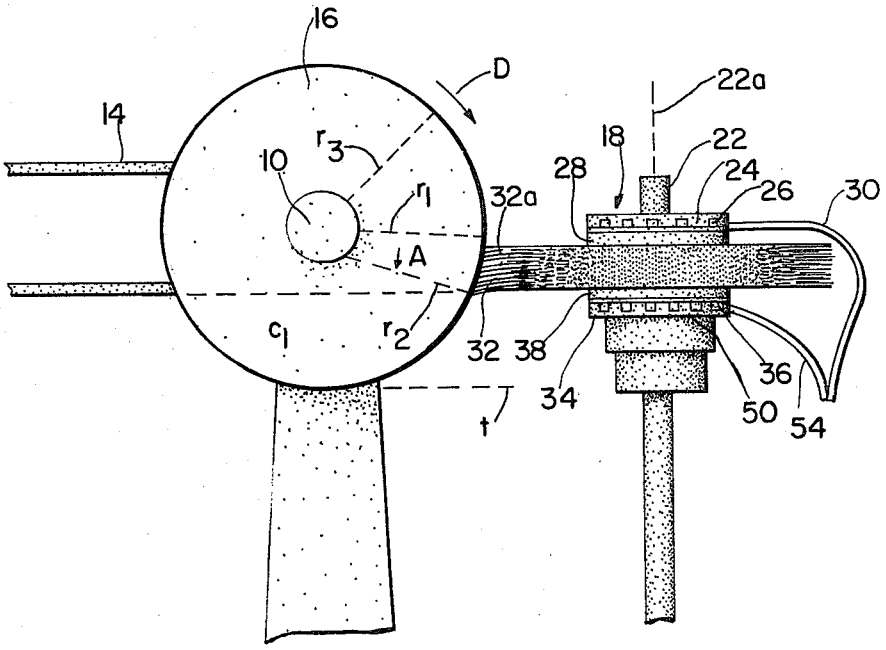
FIG. 2 is a front elevational view of the electrical conductor arrangement shown in FIG. 1.

Referring to FIGS. 1 and 2, an electrical conductor arrangement according to the invention is shown. The system includes a shaft 10 which rotates at high speeds, and is driven, for example, by a pulley 12 affixed thereto and a cooperating drive belt 14. Also mounted on shaft 10 is an electrically conductive worm helix 16.

Figure 3A:
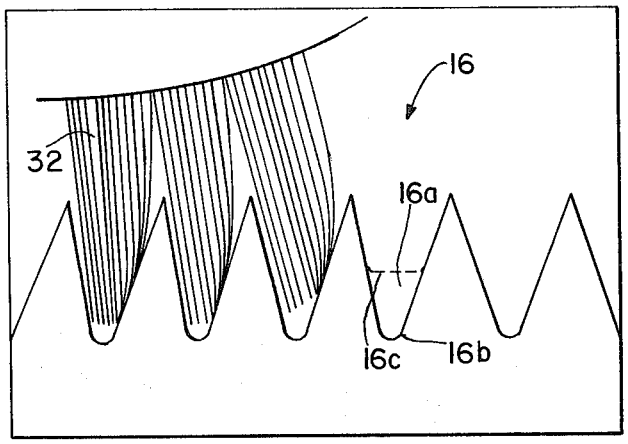
FIG. 3*a* is a side elevational view taken in cross-section of a portion of the grooves of the worm shown in insert AA of FIG. 3.

Worm 16 comprises a helical groove formed in a cylindrical body mounted on shaft 10 coaxial therewith. Referring to FIG. 3*a*, the shape of grooves 16*a* are preferably such that the walls 16*b* defining the grooves provide maximum surface area. A flat groove, such as indicated in dotted lines at 16*c*, is the least desirable form.

A flexuous electrical contactor disc assembly, generally denoted 20, comprising a plurality of conductive fibers 32 projecting radially from a central hub (not seen in FIGS. 1 and 2 but described hereinbelow), is rotatably mounted on a support shaft 22. As illustrated, disc assembly 20 is positioned such that side portions near the ends of conductive fibers 32 engage the groove walls 16*b* of worm 16. Thus, as worm 16 rotates, successive ones of the fibers 32 contact groove walls 16*b* of worm 16 and are advanced causing conductive disc assembly 20 to rotate about its axis, this axis being denoted 22*a*.

As can best be seen in FIG. 2, as worm 16 rotates in a direction D, the tips of fibers 32, denoted 32*a*, deflect in that same general direction and are not compressed toward axis 22*a*. The deflection of the fibers 32 is slight or mild and regular, always being in the direction of rotation. However, even this mild deflection can be reduced dramatically by changing the point of contact of the sides of the deflected fiber tips 32*a* and groove walls 16*b*. Maximum deflection and minimum surface contact occur at a point where a radius $r_1$ of worm 16 is perpendicular to axis 22*a*. As the point of contact is spaced in the direction of rotation D to a contact point at radius $r_2$, deflection of tips 32*a* decreases and the surface area of contact increases. The limiting point of this process is a tangential position T providing maximum contact area and minimal deflection. However, such a position also provides minimum rotational forces for the rotation of the conductive fibers 32 and an intermediate position, such as $r_2$ is preferable. It is noted that positioning disc 20 above $r_1$, at, for example $r_3$, increases compression forces on fibers 32 and does not yield as great an increase in contact area as a corresponding shift of position below $r_1$. While positioning disc 20 at $r_3$ provides satisfactory operation, this arrangement suffers some of the disadvantages of the prior art systems such as, for example, compression of fibers 32. Thus, greater contact area between worm 16 and fibers 32 and reduced deflection forces acting on fibers 32 result in improved lower heat characteristics and lower wear performance while providing positive, reliable electrical contact even at high shaft speeds.

It should be noted that disc 20 rotates at a reduced rate of speed relative to shaft 10, as determined by the radius of the disc and the number of grooves per inch of worm 16, thereby permitting more reliable electrical current pickup between rotating and stationary parts of the rotational mounting described hereinbelow.

Figure 3:
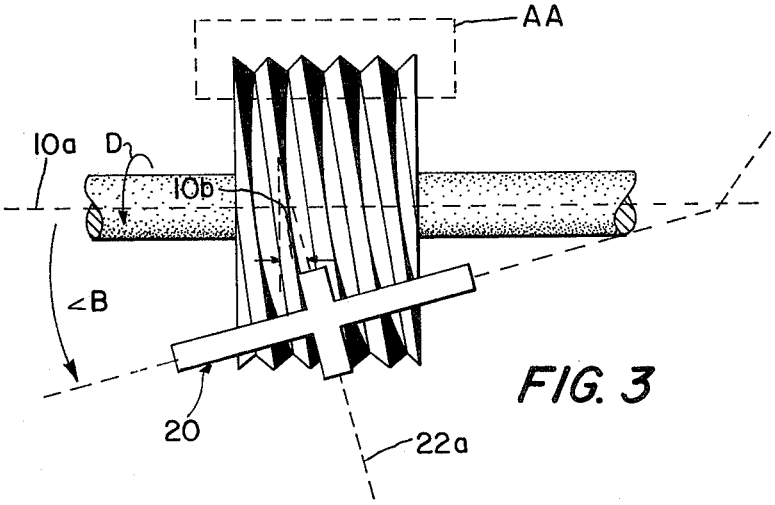
FIG. 3 is a side elevational view of an electrical conductor arrangement according to the invention, showing an alternative positioning thereof.

Referring to FIG. 3, an alternative positioning method is shown. More specifically, as shown, axis 22*a* of flexuous contactor disc 20 is positioned at an angle which is oblique to a plane perpendicular to the axis 10*a* of worm 16, this oblique angle being denoted 10*b*. In the positions described in connection with FIGS. 1 and 2, axis 22*a* of flexuous contactor disc 20 lies in a plane perpendicular to axis 10*a*. Positioning flexuous contactor disc 20 as shown in FIG. 3 provides increased frictional rotational driving forces on disc 20 while maintaining a high contact area and minimal fiber deflection. If, for example, a very fine fiber is used for the flexuous conductive fibers 32, the rotational "advancement" forces on the fibers may be insufficient to overcome the frictional forces in the rotational mounting of the disc 20 containing the assembly of fibers. Canting axis 22*a* of the disc assembly as represented by <B in FIG. 3, provides an optimum turning moment for the disc 20 while maintaining high contact area and minimal fiber deflection. It has been determined that optimal results occur if axis 22*a* is canted at an oblique angle 10*b* of between 30 and 40 degrees from a plane perpendicular to axis 10*a* of shaft 10. In some instances an angle of only 5° resulted in acceptable performance. These results were derived using a worm having 8 grooves per inch and a diameter of 3 inches under circumstances where the contact point between fibers 32 and worm 16 was approximately 18° (Angle A in FIG. 2).

Figure 6:
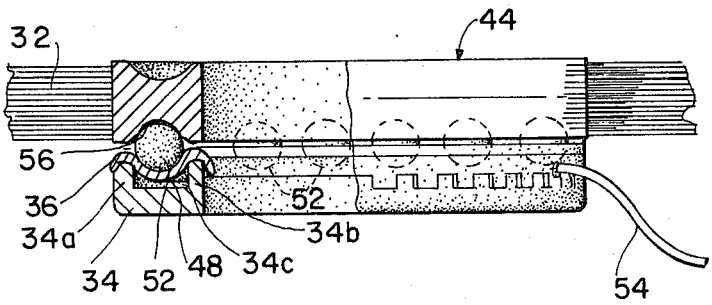
FIG. 6 is a side elevational view in partial cut away of the rotatable mounting of the disc assembly shown in FIG. 4.

Referring to FIGS. 4, 5 and 6, the details of the flexuous electrical contactor disc assembly, and the rotational mounting therefor are shown. Flexuous contactor disc 20 includes a central electrically conductive annular hub 44 from which flexible conductive fibers 32 project, and a rotational mounting for hub 44 comprising first and second electrically conductive ball bearing assemblies 28 and 38, a pair of electrically conductive flexible races 26 and 36, a pair of support members 24 and 34, retaining discs 18 and 50, and parallel circuit electric wire conductors 30 and 54. The inter-relationship of these components when assembled is perhaps best seen in FIG. 6.

Hub 44 has an annular groove or race on each side thereof, the lower race being denoted 56. Ball bearing assembly 38 includes a plurality of electrically conductive balls 52 contained in a conventional bearing ring cage 52*a* and is designed so as to cooperate with the race 56 and to ride therein. An electrically conductive flexible race 36 positioned in a support member 34 which is fixedly mounted on shaft 22, further cooperates with ball bearings 52 and provides electrical contact between fibers 32 and conductor 54. The flexible race is constructed of spring-like material and is supported by outer edge 34*a* and inner edge 34*b* of support member 34. The central portion of race 36, denoted 48 is left unsupported in a space 34*c* between inner and outer edges 34*a* and 34*b*. The aforedescribed flexible race structure is the subject of co-pending application No. 555,277 and is described in detail therein. While the components shown in FIG. 6 are sufficient for satisfactory operation, the complementary upper set of components shown in FIG. 4 is provided in order to share high electrical current loads and to further reduce rotational friction.

Although the invention has been described with respect to an exemplary embodiment thereof, it will be understood that variations and modifications can be effected in the embodiment without departing from the scope or spirit of the invention.

I claim:

1. An electrical conductor arrangement for conducting electrical current between a rotating shaft and a non-rotating conductor comprising:

an electrically conductive worm mounted on the rotating shaft so as to rotate therewith;

a conducting flexible contactor disc assembly comprising:

an electrically conductive annular central hub portion and a plurality of flexible electrically conductive fibers secured to a central annular hub portion and projecting radially outwardly therefrom;

support means for supporting said conducting brush assembly such that the free ends of said conductive fibers engage in the grooves in said worm; and an electrically conductive rotational mounting means for rotatably mounting said central hub portion on said support means and for providing an electrical path between said flexible conductive fibers and the non-rotating conductor.

2. An electrical conductor arrangement as claimed in claim 1 wherein said electrically conductive rotationally mounting comprises:

a non-rotating shaft support;

first and second rotating race means, one of said race means located on each side of said central annular hub portion;

first and second non-rotating race means mounted on said non-rotating shaft, one of said non-rotating race means positioned on each side of said central annular hub portion; and first and second electrically conductive ball bearing assemblies, said first electrically conductive ball bearing assembly located between said first non-rotating race means and said first rotating race means and said second electrically conductive ball bearing assembly similarly located between said second non-rotating race means and said second rotating race means for providing electrical current conduction between said rotating race means and said non-rotating race means.

3. An electrical conduction arrangement as claimed in claim 2 wherein said first and second non-rotating race means each comprise an annular flexible race member constructed of an electrically conductive material and a support member for supporting the circumferential edges of said race member while leaving unsupported an annular central portion of said race member located between said circumferential edges, so that said race member makes flexible contact with said bearing assemblies.

4. An electrical conductor arrangement as claimed in claim 1 wherein the axis of said conductive flexible contactor disc assembly lies in a plane perpendicular to the longitudinal axis of said worm.

5. An electrical conductor arrangement as claimed in claim 1 wherein the axis of said conductive flexible contactor disc assembly is oblique to a plane perpendicular to the longitudinal axis of said worm.

6. An electrical conductor arrangement as claimed in claim 5 wherein the angle between said axis of said conductive flexible contactor disc assembly and a plane perpendicular to the axis of said worm is approximately between 30° and 40°.

7. An electrical conductor arrangement as claimed in claim 1 wherein said edges of said conductive fibers engage the grooves of said worm at a location spaced in the direction of rotation of said worm from a line projecting radially from the axis of said worm and within a plane perpendicular to the axis of said conducting brush disc assembly.

* * * * *